United States Patent [19]

Ross et al.

[11] 4,138,074

[45] Feb. 6, 1979

[54] FRANGIBLE STRIP THREADING APPARATUS FOR ROLLING MILL

[75] Inventors: Hugh McD. Ross, Poole; Edwin Simmonds, Ringwood, both of England

[73] Assignee: Loewy Robertson Engineering Co., Ltd., Poole, England

[21] Appl. No.: 781,323

[22] Filed: Mar. 25, 1977

[51] Int. Cl.[2] ..... B21C 47/04

[52] U.S. Cl. ..... 242/78.1; 226/92; 242/55

[58] Field of Search ..... 242/78.1, 78.3, 78, 242/195, 74, 80, 71.2, 55, 54; 226/92, 91; 352/157, 158

[56] References Cited

U.S. PATENT DOCUMENTS

| | | | |
|---|---|---|---|
| 1,992,751 | 2/1935 | Jensen | 226/92 |
| 2,581,026 | 1/1952 | Keller | 226/92 |
| 3,880,382 | 4/1975 | Jantzen et al. | 242/195 |

*Primary Examiner*—George F. Mautz

*Attorney, Agent, or Firm*—Brisebois & Kruger

[57] ABSTRACT

In order to thread a frangible strip material such as aluminium foil through a rolling mill stand, the leading end of the strip at the upstream side of the stand is attached over its width to a transverse threading device. The threading device is mechanically propelled through the stand to a downstream coiler location, where the leading end is detached and coupled to the coiler. The threading device either may be drawn through the stand by means of a leader strip which is normally located at the downstream side but which can be passed through the stand and attached to the threading device, or may be pushed by semi-rigid chains which are normally located at the upstream side and which carry the threading device.

7 Claims, 5 Drawing Figures

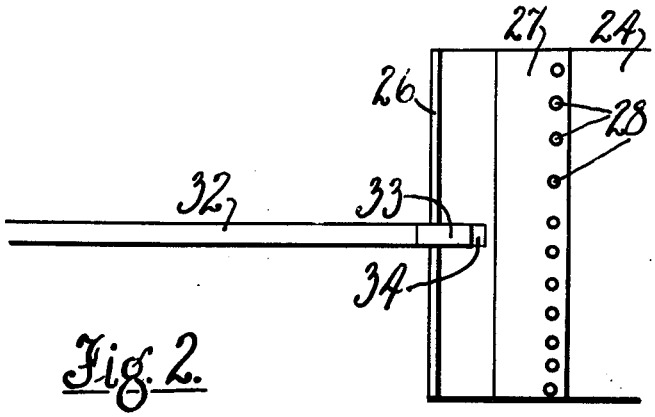
Fig. 2.
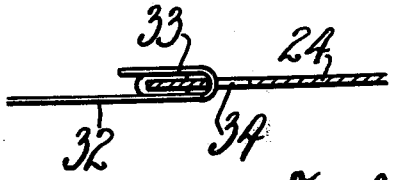
Fig. 3.
Fig. 4.
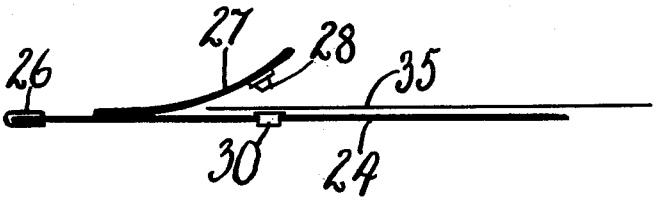

FRANGIBLE STRIP THREADING APPARATUS FOR ROLLING MILL

This invention relates to the rolling of thin, readily tearable, material such as aluminium foil and is particularly concerned with the initial threading of such a material through the roll gap of a mill prior to the rolling operation.

Aluminium foil is highly fragile material which is easily torn. Any tear present in the foil, however small, causes the foil to break in two, necessitating stoppage of the mill and rethreading. Even a fold in the foil, arising during threading, may give rise to tearing of the foil across its width when rolling tension is applied.

Consequently, the threading of the leading end of a coil of foil strip, which is done by hand, requires a high degree of skill, experience and care, and is time consuming. Even so, tearing may occur and rethreading become necessary with resulting loss of production time.

An object of this invention is to reduce the danger of tearing during or after threading.

Another object is to machanise the threading operation so as to avoid the need for skilled handling during threading and improve the timing and effectiveness of threading.

Yet another object is to provide mechanical threading equipment, which, once the leading end of a coil of strip is attached, draws the leading end through the roll gap by applying tension evenly over the width of the strip.

The invention, broadly stated, resides in the following steps:

(a) locating said coil on a reel upstream of a rolling mill stand;

(b) temporarily attaching the leading end of said coil to a threading device over a substantial proportion of the width of said strip material;

(c) causing said threading device to move away from said reel to draw said leading end without tearing to said stand at least;

(d) detaching said leading end from said threading device;

(e) attaching said leading end to a coiler downstream of said stand; and (f) removing said threading device from the passline.

The invention further provides, in a strip rolling mill comprising a rolling mill stand, a reel for supporting a coil prior to rolling, and a coiler for receiving rolled strip; apparatus for threading the leading end of frangible strip material on said reel through the roll gap of said stand, said apparatus comprising:

a threading device having means for temporarily attaching said leading end over a substantial proportion of the width of said strip material; and means for guiding and propelling said threading device from a location adjacent said reel at least to said roll gap.

Figure 1:
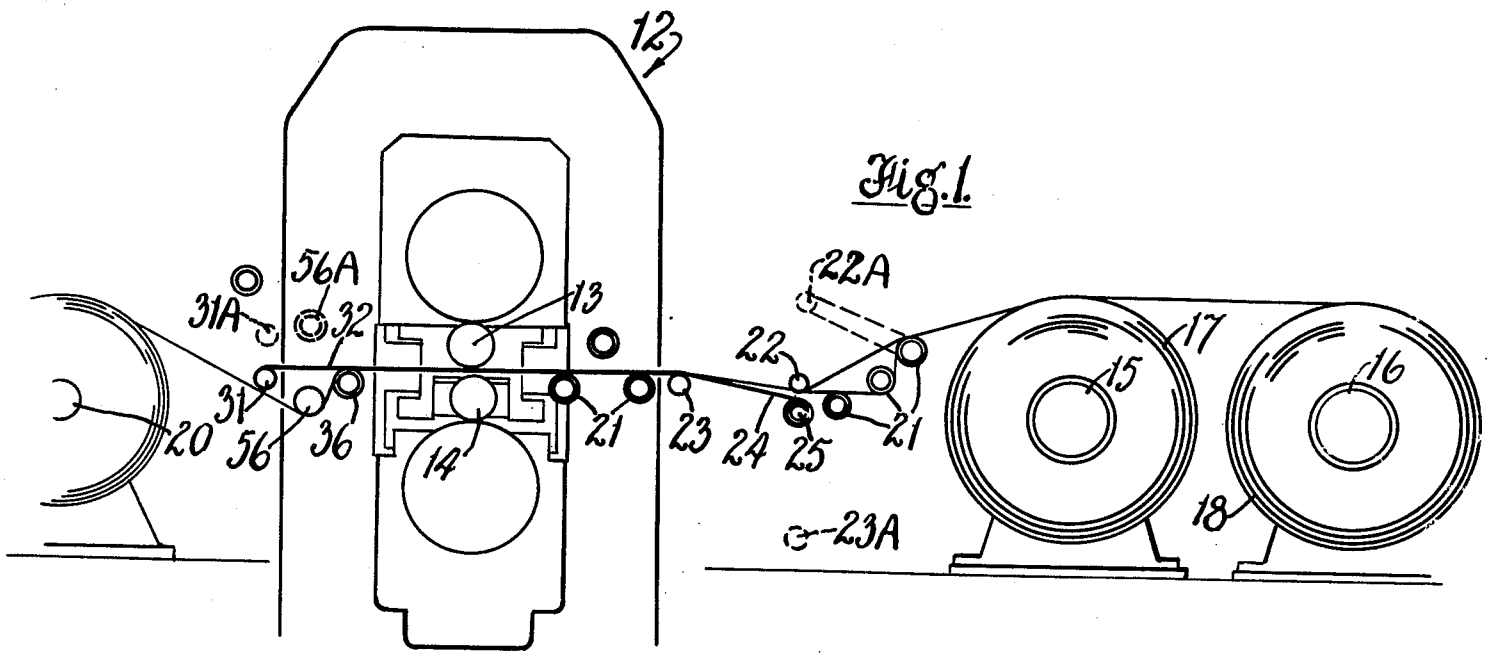
Figure 5:
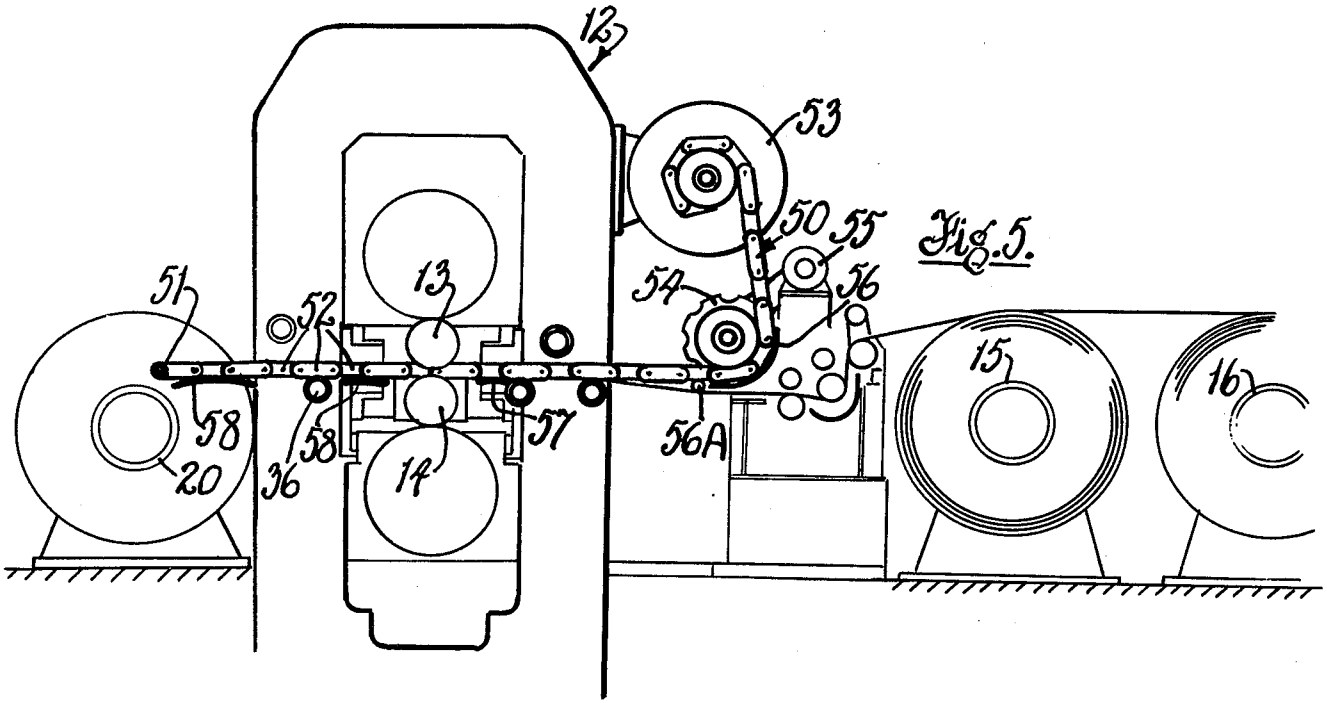

The invention will be more readily understood by way of example from the following description of rolling methods and threading apparatus for use with frangible elongate material, exemplified by aluminium foil strip. Reference is made to the drawings accompanying the provisional specification, in which:

FIG. 1 is a side view of an aluminium foil rolling mill, including threading apparatus for threading the leading end of the strip through the mill, FIG. 2 is a plan view of a threading device used in the mill of FIG. 1, FIG. 3 is a side view of the threading device of FIG. 2, FIG. 4 is a side view of a part of the threading device, illustrating the connection of that device to the leading end of the foil strip, and FIG. 5 is a side view of the same mill, with a different form of threading device.

The rolling mill is illustrated as consisting of a mill stand 12 having work rolls 13 and 14, two spools 15, 16 at the upstream of the stand for receiving coils of foil strip 17, 18, and a take-up spool 20 on the downstream side of the stand for taking up the rolled foil.

Between the spool 15 and the stand 12 there are a number of guide rollers 21, which are to guide the foil from the coils 17, 18 to the stand during rolling. In addition, there are additional guide rollers 22, 23 each of which is carried on an arm enabling each roller to be withdrawn from the position shown in FIG. 1 and adopted during threading, to a retracted position shown in chain line at 22A, 23A, which is adopted during rolling. An exit roll 36 is located downstream of the mill rolls where there is also a tension roll 56, which is retractable to position 56A for threading of the mill.

A flexible shutter member 24 is wound about a core 25 disposed below roller 22 and beneath the normal passline of the foil to the mill stand 12. The core 25 is biased in a direction to cause winding up of the shutter 24. As shown in FIGS. 2 to 4, the free end of shutter 24 has a reinforced edge 26 and carries a backwardly directed flap 27, which overlies a part of the shutter member 24. Flap 27 carries a line of industrial-type press studs 28, which are received in co-operating sockets 30 on the shutter 24.

Adjacent the downstream side of the stand 12, and on the level of the roll gap between rolls 13, 14, a spool 31 carries a thin semi-rigid leader strip 32, which is located centrally of the barrels of rolls 13, 14. The leader strip has, at its free end, a hook 33, which can be passed through an opening 34 in the shutter 24 in order to couple the two together.

For threading , the work rolls 13, 14 are opened, the rollers 22, 23 are brought into the positions shown, and the spool 31 is moved from a retracted position shown in chain line at 31A to the operative position in full line. The leader strip 32 is fed through the roll gap, by turning the spool 31 by hand or by operation of a low power motor, until the leading, hooked, end reaches the roller 23. The shutter 24 is drawn off its magazine against the spring bias and coupled to the leader strip, as described.

Next, the leading end or ends of one or both of coils 17, 18 is or are led round the guide rollers 21 and 22 as shown and entered between the flap 27 and the shutter beneath, i.e. as indicated at 35 in FIG. 4. The flap 27 is closed to engage the press studs 28, 30 through the foil, so that the leading end of the foil strip becomes temporarily attached to the shutter 24. The width of shutter 24 is equal to the maximum width to be rolled by the mill, so that the threading device is attached over the entire width of the strip and the subsequently applied tension is not concentrated over a small width of the strip with the attendant danger of tearing. Roller 22, when in its lowered position as shown in FIG. 1, guides the strip into the nip between flap 27 and shutter 24, while roller 23 raises the leader strip 32, and subsequently the shutter 24, above the level of the entry rollers 21.

Spool 31 is then rotated, by hand or by motor, to draw the leader strip 32 through the roll gap, and with it the shutter 24 and the attached leading end of the strip or each strip. When the leader strip has been entirely wound up on spool 31, the leading end of the foil strip lies between that spool and the exit roller 36 of the mill. The hook 33 is detached from the shutter 24 and the latter is drawn out by hand, until it is adjacent the take-up spool 20. Then the foil strip or strips is or are detached from the shutter by releasing the press studs 28, 30 and attached to the spool 20. Finally, the shutter is released, so that it passes back through the roll gap under the spring action of the shutter magazine. The rollers 22, 23 and the spool 31 are withdrawn to their inoperative positions shown in chain line, and rolling commenced.

It will be seen that, by use of the threading device, the leading end of the foil strip or strips is drawn off the coil 17 and/or 18 and through the roll gap, without manual contact with the foil. During the threading, the leading end of the foil strip or strips is continuously supported by the shutter 24, so that there is no danger of it becoming entangled with the entry rollers 21 or the exit roller 36. The tension applied to the foil strip or each strip during threading is applied across the entire width of the strip, so that there is little danger of the foil tearing or buckling. By these means, threading can be performed with economy of time and skilled labour.

The threading device, comprising the leader strip 32 and the shutter 24, is only one example of a number of mechanisms that may be employed in order to achieve mechanical threading of the leading end of the foil through the roll stand. For example, the shutter magazine 25 may be located on the downstream side of the mill stand, the free end of the shutter being fed through the roll gap to the up-stream side for attachment to the foil; in that case, flap 27 is directed away from the magazine, and the leader strip 32 is housed in its spool on the upstream side of the mill.

Another form of threading device is illustrated in FIG. 5 where the mill 12, the pay-off spools 15, 16 and the take-up spool 20 are similar to those illustrated in FIG. 1. The threading device of FIG. 5 comprises a pair of chains 50, which can be passed through the mill. The chains 50 are located at opposite sides of the roll barrels and between the roll ends, and are of the type, commercially available, which are self-supporting in one direction but are rockable about their pins in the opposite direction. Thus, the chains are coilable in one direction only, and when uncoiled and threaded through the mill remain substantially horizontal without the need for further support. The foremost links of the chains 50 are interconnected by a transverse rod 51.

While the mill is in operation, each chain 50 is carried on a chain store reel 53, supported from the housing of stand 12 at the upstream side; the reel is driven by a low power reversing motor. A sprocket 54 is located below each reel 53 and is driven by a motor 55 through a sprag clutch (not shown). Guides for the chains are provided at 56 around the sprocket 54 and at 57, 58 at the entry and exit sides of the roll gap. A further support in the form of a roller 56A is also provided for each chain adjacent the sprocket 54.

For threading, the mill is opened by lowering work roll 14 and its back-up roll so that links 52 of each chain can pass between the ends of the work rolls 13, 14. The motors of reels 53 are operated to deliver the chains 50 to the sprockets 54. Motors 55 are then also energised to urge the leading ends of the chains around the sprockets until they reach a position between the stand 12 and sprockets 54. The motors are stopped and the leading end of the foil strip or strips is or are attached to the rod 51, the attachment being over the entire width of the strip or strips. The motors for the reels and sprockets are re-energized and the chains caused to pass through the mill until the rod 51 passes the exit roller 36, when the foil is detached from the rod 51, drawn out by hand and attached to the take-up spool 20. Then, the motors driving reels 53 are reversed to wind the chains 50 back on to reels 53, the clutch between motors 55 and sprockets 54 allowing the sprockets to free-wheel during the reverse motion. When the chains have been properly wound back on to the reels 53, the roll gap is set, the various guide rollers positioned appropriately, and the mill can be put into operation.

It is also possible to use either of the above described threading devices to feed the leading end of the strip or strips only as far as the bite between the work rolls of the mill. In that case, the rolls themselves are rotated to feed the leading end of the strip through the stand. On emerging from the rolls, the strip is guided by hand to the spool 20; being fed under zero tension, it is subject to minimal risk of tearing.

What we claim as our invention and desire to secure by Letters Patent is:

1. In a strip rolling mill comprising a rolling mill stand, a reel for supporting a coil prior to rolling, and a coiler for receiving rolled strip; apparatus for threading the leading end of frangible strip material from said reel through the roll gap of said stand, said apparatus comprising:
   (a) a flexible support band to underlie and support at least a substantial proportion of the width of said strip and movable from said reel towards said stand, said band having a length sufficient to extend from a location adjacent said reel to at least said roll gap;
   (b) means for temporarily attaching said leading end to said band over the width thereof with said band located beneath and supporting said strip; and
   (c) means for propelling said band from said location adjacent said reel at least to said roll gap, said band comprising means for supporting said strip over at least a substantial portion of the length of said strip from said location to at least said roll gap.

2. Threading apparatus as claimed in claim 1, wherein said band is coiled at said location when not required for threading and is withdrawn from coiled form for threading.

3. Threading apparatus as claimed in claim 2, wherein said band is spring-biased into coil form.

4. Threading apparatus as claimed in claim 1, wherein said attaching means includes a flap carried by said band to receive said leading end of said strip.

5. In a strip rolling mill comprising a rolling mill stand, a reel for supporting a coil prior to rolling, and a coiler for receiving rolled strip; apparatus for threading the leading end of frangible strip material from said reel through the roll gap of said stand, said apparatus comprising:
   (a) a flexible support band extending over at least a substantial proportion of the width of said strip and movable from said reel towards said stand;
   (b) means for temporarily attaching said leading end to said band over the width thereof with said band located beneath and supporting said strip; and (c) means for propelling said band from a location adjacent said reel at least to said roll gap, wherein said attaching means includes a flap carried by said band to receive said leading end of said strip, and press studs spaced along the width of said flap for securing said leading end of said strip.

6. In a strip rolling mill comprising a rolling mill stand, a reel for supporting a coil prior to rolling, and a coiler for receiving rolled strip; apparatus for threading the leading end of frangible strip material from said reel through the roll gap of said stand, said apparatus comprising:

(a) a flexible support band extending over at least a substantial proportion of the width of said strip and movable from said reel towards said stand;

(b) means for temporarily attaching said leading end to said band over the width thereof with said band located beneath and supporting said strip; and (c) means for propelling said band from a location adjacent said reel at least to said roll gap, and wherein said propelling means include a semi-rigid leader strip which is attachable to said band.

7. Threading apparatus as claimed in claim 6, wherein said leader strip is normally located downstream of said stand and there are means for passing said leading strip through said roll gap towards said reel and for withdrawing said leading strip to draw said band towards said coiler.

* * * * *